United States Patent [19]

Hagita et al.

[11] Patent Number: 4,688,411

[45] Date of Patent: Aug. 25, 1987

[54] METHOD FOR CONTINUOUS DRAWING OF WIRE ROD

[75] Inventors: Hyoji Hagita; Takashi Fukuda, both of Kitakyushu; Shigeru Maeda, Handa; Hideo Imamura, Handa; Kazutosi Ogata, Handa; Masahiro Fukuoka, Aichi, all of Japan

[73] Assignee: Sumitomo Metal Industries, Inc., Osaka, Japan

[21] Appl. No.: 942,847

[22] Filed: Dec. 17, 1986

Related U.S. Application Data

[63] Continuation of Ser. No. 733,794, May 14, 1985, abandoned.

[51] Int. Cl.[4] ..... B21C 9/02

[52] U.S. Cl. ..... 72/42

[58] Field of Search ..... 72/39, 41, 42, 43, 44, 72/46, 274; 148/6.15 R, 6.15 Z; 427/318, 327; 252/12

[56] References Cited

U.S. PATENT DOCUMENTS

| | | | |
|---|---|---|---|
| 2,871,140 | 1/1959 | Goss | 72/42 X |
| 2,990,610 | 7/1961 | Luckerath et al. | 72/42 |
| 3,250,103 | 5/1966 | Beaubien et al. | 72/42 |
| 3,923,673 | 12/1975 | Van Henten et al. | 72/42 |
| 4,308,182 | 12/1981 | Eckard et al. | 72/42 X |
| 4,529,451 | 7/1985 | Otrhalek et al. | 148/6.15 Z |
| 4,553,416 | 11/1985 | Sudoh et al. | 72/40 |
| 4,575,430 | 3/1986 | Periard et al. | 72/42 X |

FOREIGN PATENT DOCUMENTS

| | | | |
|---|---|---|---|
| 0053636 | 6/1982 | European Pat. Off. . | |
| 1103108 | 3/1961 | Fed. Rep. of Germany . | |
| 2402702 | 8/1974 | Fed. Rep. of Germany | 148/6.15 Z |
| 2357045 | 5/1975 | Fed. Rep. of Germany . | |
| 204420 | 11/1983 | German Democratic Rep. . | |

*Primary Examiner*—E. Michael Combs

*Attorney, Agent, or Firm*—Burns, Doane, Swecker & Mathis

[57] ABSTRACT

A wire rod is payed out from a pay-off stand and descaled in a descaling process. After preheating to a predetermined temperature by a preheating device, it is subjected to a lubrication pretreatment through a zinc calcium phosphate solution applied with ultrasonic wave in the lubrication pretreatment process. After rinsing process, the lubrication-pretreated wire rod is coated with a calcium stearate or a sodium stearate in lubricating process. Thereafter, the wire rod is dried sufficiently in drying process, and then added with a predies lubricant in wire drawing process and coiled by a coiler.

7 Claims, 14 Drawing Figures

METHOD FOR CONTINUOUS DRAWING OF WIRE ROD

This application is a continuation of application Ser. No. 733,794, filed May 14, 1985 abandoned.

The present invention relates to a method for continuous drawing of a wire rod for cold-forging, in which the wire rod (inclusive of a steel bar) is descaled, pretreated for lubrication, lubricated and drawn into wire while being moved continuously.

Secondary working for a wire rod for cold-forging is performed normally in the order: descaling (pickling-)—lubrication pretreatment—lubrication—drying—wire drawing—coiling. Among them, pickling, lubrication pretreatment and lubrication are usually rendered in batch treatment system. That is, heretofore, a pickled wire rod coil was dipped in a phosphate solution of, for example, zinc phosphate and, thereafter, dipped in a lubricate solution of, for example, sodium stearate to form a lubricate coating of such materials as sodium stearate, zinc stearate, or zinc phosphate on the surface of the wire rod. The batch treatment system was heretofore used for the reason that a long period of reaction was required to obtain a coating having a thickness sufficient to provide satisfactory lubricating properties, this required a longer treatment time and made an in-line system difficult.

Therefore, in, for example, Japanese Patent Public Disclosure No. 163047/1981 Official Gazette, there is proposed a method for performing lubrication pretreatment and lubrication in an in-line system to thereby reduce equipment cost and improve productivity. This prior art method has been put into practical use. This prior art method is characterized in that, after descaling, a wire rod is coated with zinc phosphate (lubrication pretreatment), further coated thereon with calcium stearate at room temperature (lubrication), and then rapidly dried. In this prior art method, it is made possible to reduce running cost, to coat a required quantity of lubricant in a very short time, to dry it in a short time, and to make it in an in-line system without extending the entire line unduly.

According to prior art methods, however, any of the batch treatment system or the in-line system used zinc phosphate solution as the lubrication pretreatment, and therefore, had a disadvantage that the lubricant coating had unsatisfactory resistance to heat.

Generally in metal wire drawing operation, as described above, lubricant is indispensable to improve the working efficiency, to prolong the tool life, and to maintain the surface quality of drawn wire.

The lubricant for wire drawing reduces the friction between the dies and the wire rod to thereby make it possible to draw the wire rod with a smaller drawing force and prevents wear of the dies. In addition to these functions, the lubricant has important advantage that it remains securely as a coating on the surface of the wire after drawing and acts as an effective lubricant during cold forming (for example, bolt making).

Heretofore, a predies lubricant having metallic soap as the main component as follows was normally used in drawing wire:

| | |
|---|---|
| metallic soap: | 60–80% (by weight) |
| inorganic material: | 20–40% (by weight) |

-continued

| | |
|---|---|
| additives: | several % (by weight) |

In the prior art lubricant for wire drawing having metallic soap as the main component in which the metallic soap displays the basic lubricating properties, stearate or palmitinate of alkali earth metals or sodium were normally used. The typical inorganic material used in the prior art wire drawing lubricant is lime which prevents temperature rise in heavy working to thereby prevent adhesion between the wire rod and the dies and to control the softening temperature of the lubricant. The additives used in the prior art were one or more of sulfur, molybdenum disulfide and graphite which were added to prevent adhesion between the wire rod and dies under severe wire drawing conditions and to improve the lubricating properties.

However, while the prior art wire drawing lubricant having metallic soap as the main component had better properties than other wet type lubricants, it was still insufficient in the lubricating properties such as resistance to heat produced in drawing and adhesiveness of the lubricant coating formed, which made the life of the wire drawing dies and the life of the dies for cold-forging subsequent to drawing relatively short.

The drawn wire rods are mostly cold-forged into products. However, it has become a recent trend that the lubricant used in the wire drawing is left adhering onto the surface of the wire brought to the cold-forging process so that the wire can be cold-forged into products without adding any lubricant. Therefore, while much better adhesiveness after wire drawing and higher heat-resistance sufficient to prevent cracking in the adhering lubricant coating after wire drawing have been demanded for the lubricant for wire drawing, no successful lubricant for wire drawing which satisfactorily answer to these demands has been found yet.

SUMMARY OF THE INVENTION

An object of the present invention is to provide a method for continuous drawing of wire rod, in which the wire rod is descaled, pretreated for lubrication, lubricated, dried and drawn into wire in an in-line system to thereby make it possible to obtain a lubricant coating highly resistant to heat and to carry out the wire drawing operation efficiently in a shorter period of time than prior art methods.

Another object of the present invention is to provide a lubricant for wire drawing, which is capable of overcoming the above-described problems of the prior art lubricants and has highly desirable properties such as reduction in friction, resistance to heat, and deposition and adherence to the wire rod, to thereby prolong the life of the dies for wire drawing and cold-forging.

The continuous wire drawing method according to the present invention is characterized in that a descaled and preheated wire rod is pretreated for lubrication by passing it through a calcium zinc phosphate solution (Ca/Zn=0.3–1.0) maintained in the temperature range 70° C.–90° C. and added with an ultrasonic wave (frequency: 10–60 KHZ, output: 25 W/1 liter solution), rinsed, lubricated by causing calcium stearate to adhere to it at room temperature or passing it through a sodium stearate solution maintained in the temperature range 70° C.–90° C., dried and then drawn into wire. Further, in said wire drawing operation, the predies lubricant having metallic soap as the main component added with 1-10 weight % of a thermoplastic resin (for example, Teflon, polyethylene, nylon, acrylic resin, polycarbonate) is used.

We have discovered that in wire drawing operation addition of a thermoplastic resin to the prior art predies lubricant having metallic soap as the main component improves the lubricating properties of the lubricant considerably. That is, by adding 1-10% by weight of a thermoplastic resin to the prior art predies lubricant having metallic soap as the main component, the lubricating properties of the lubricant, such as reduction of friction and resistance to heat, can be greatly improved.

Addition of the thermoplastic resin in less than 1% by weight is insufficient to improve the lubricating properties satisfactorily. On the other hand, addition of it in more than 10% by weight increases the cost unduly and may result in generation of thermally decomposing gases during heat treatment after cold-forging. Particularly when any of fluorine-contained polymers is used, addition of it in a percentage higher than specified above is accompanied by the risk of generation of fluoric gas during heat treatment after cold-forging. Accordingly, great care must be taken in determination of the percentage of addition of the thermoplastic resin.

The term "metallic soap" as used herein is to be understood to mean metallic salts other than alkali salt, of, such as, fatty acid, resin acid and naphthenic acid, inclusive of sodium salt of these acids and their mixtures, preferably of common composition (commonly used as wire drawing lubricant) containing calcium stearate or sodium stearate in 90% or more in weight added with one or more of aluminum stearate, zinc stearate and barium stearate in several percent by weight.

Further, the term "a predies lubricant having metallic soap as the main component" as used herein is to be understood to mean any of lubricants containing said metallic soap in 60% or more by weight, inorganic material (such as lime) in 20% or more by weight, and several percent of additives (one or more of sulfur, molybdenum disulfide and graphite), that is, this term is applicable to any of known wire drawing lubricants.

The term "thermoplastic resin" as used herein is to be understood to apply to any of polyethylene resin, polypropylene resin, fluorine-contained polymers known as Teflon (trademark), polystyrene resin, vinyl acetal resin, polyacrylate resin, polymethacrylate resin, polyvinyl chloride resin, polyvinylidene chloride resin, polyacrylonitrile resin, polyvinylether resin, polyvinylketone resin, polyether resin, polycarbonate resin, thermoplastic polyester resin, polyamide resin, diene resin, polyurethane resin, and silicone resin. These resins are used solely or in combination of two or more kinds of them.

The thermoplastic resin is added preferably in the form of powder of the size approximately of 10-20 μm diameter.

BRIEF DESCRIPTION OF THE DRAWINGS

The invention will be better understood from the following description taken in connection with the accompanying drawings in which.

DETAILED DESCRIPTION OF THE PREFERRED EMBODIMENTS

Figure 1:
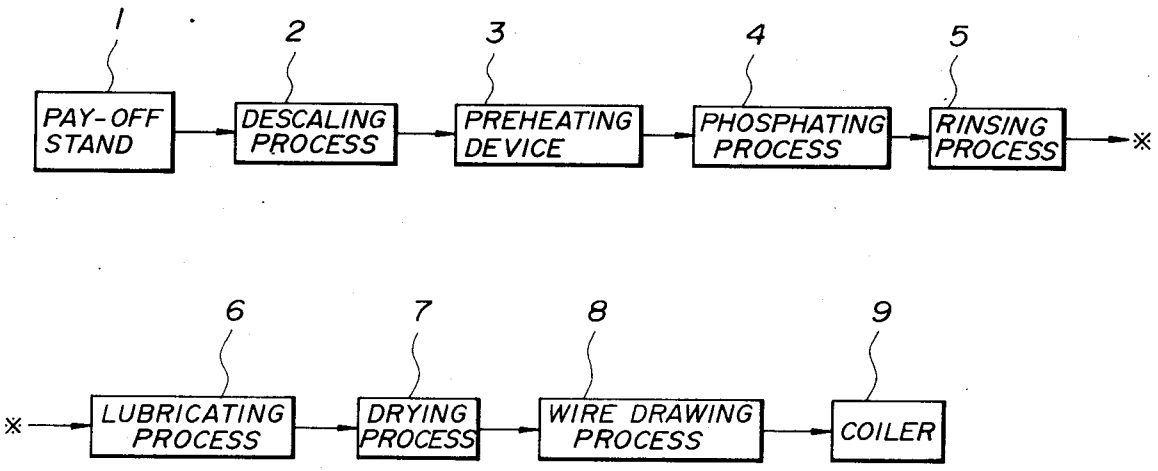
FIG. 1 is a block diagram of the process of the method for continuous drawing of wire rod according to the present invention.

With reference now to the drawings and more particularly to FIG. 1 thereof, there is shown in block diagram treating processes of the method according to the present invention. As shown, a wire bar is payed out from a pay-off stand 1 and descaled in descaling process 2 by, for example, shot blasting. Subsequently, the wire rod is preheated by a preheating device 3 to a predetermined temperature (80° C. or higher) and then pretreated for lubrication in lubrication pretreatment process 4 by passing it through a calcium zinc phosphate solution (Ca/Zn=0.3-1.0) added with an ultrasonic wave. The calcium zinc phosphate solution is preheated to the temperature 70°-90° C. Then, after rinsing process 5, the pretreated wire rod is lubricated by calcium stearate or sodium stearate to adhere thereto in lubricating process 6. Lubrication by calcium stearate is carried out at room temperature. However, sodium stearate is to be preheated to 70°-90° C. for lubrication in process 6. After lubricated, the wire rod is dried sufficiently in its lubricant coating in drying process 7, drawn with a predies lubricant in wire drawing process 8, and coiled by coiler 9.

Method of descaling rod used in descaling process 2 is not limited. Any of pickling, shot blasting and roll bending may be used to descale the rod in process 2. Among the three methods mentioned above, shot blasing is most preferable for the phosphate coating in an in-line system.

The method according to the present invention is characterized in that calcium zinc phosphate (Ca/Zn=0.3-1.0) having a good resistance to heat is used in process 4 to pretreat the wire rod for lubrication. The temperature of removing crystal water of the calcium zinc phosphate coating is 415° C. while the temperature of removing crystal water of the heretofore used zinc phosphate coating is 280°-290° C. This means that the prior art zinc phosphate coating is removed of its crystal water by the heat (normally up to 300° C.) developed during wire drawing operation to thereby cause cracks in the coating. In contrast to this, since the temperature of removing crystal water of the calcium zinc phosphate coating according to the present invention is, as mentioned above, as high as 415° C., no crack is caused in the coating by the wire drawing operation.

Figure 2:
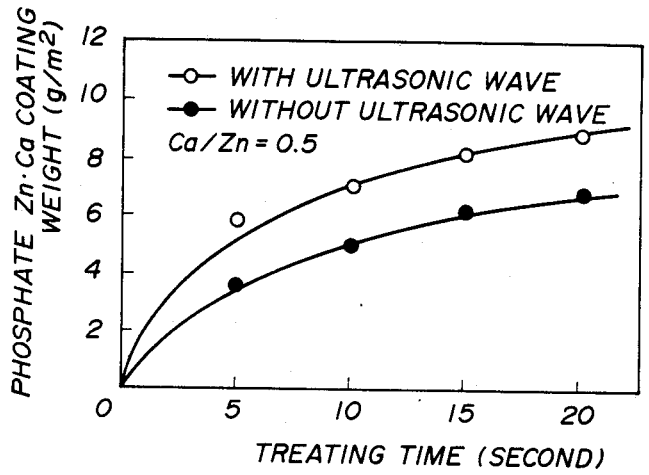
FIG. 2 is a graph showing the effect of application of an ultrasonic wave to lubrication pretreatment in the present invention.

The method according to the present invention is characterized in that an ultrasonic wave is used in treatment to obtain a sufficient zinc calcium phosphate coating weight and to control the coating weight. This is because the calcium zinc phosphate solution is less sensitive to chemical conversion treatment than the zinc phosphate solution and is more difficult to obtain the coating weight. However, as shown in FIG. 2, the zinc calcium phosphate coating weight is increased by application of the ultrasonic wave thereto. The results shown in FIG. 2 were obtained under the treatment conditions: concentration 160 points, temperature 80° C., and frequency of the ultrasonic wave 50 KHZ at 1 KW.

Figure 3:
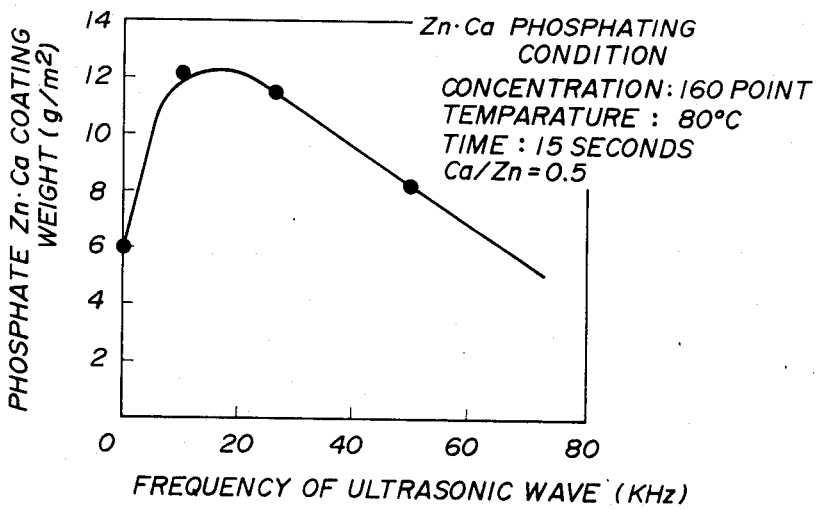
FIG. 3 is a graph showing the relationship between the frequency of the ultrasonic wave and the zinc calcium phosphate coating weight.

As shown in FIG. 3, the frequency of the ultrasonic wave applied to the solution is preferably in the range 10-60 KHZ because the frequency lower than 10 KHZ presents a problem of noise and, on the other hand, the frequency higher than 60 KHZ is less effective to obtain a sufficient coating weight. Output of the ultrasonic wave is preferably 25 W per liter of the solution.

Figure 4:
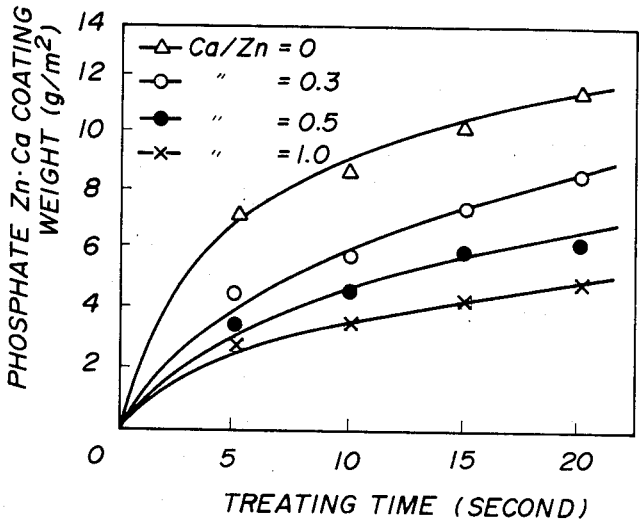
FIG. 4 is a graph showing the relationship between Ca/Zn ratio of the calcium zinc phosphate coating and the zinc calcium phosphate coating weight.

The Ca/Zn ratio of the calcium zinc phosphate coating is determined to 0.3-1.0 for the reason described below. FIG. 4 shows the relationship between the Ca/Zn ratio of the calcium zinc phosphate coating (concentration of the solution 160 points) and the coating weight. As understood from FIG. 4, when the Ca/Zn ratio is lower than 0.3, effect of addition of Ca is small and the resistance to heat is not sufficient. On the other hand, when the Ca/Zn ratio is higher than 1.0, the sensitiveness to chemical conversion treatment is not sufficient and it is difficult to obtain a predetermined coating weights ($\geqq 6$ g/m$^2$) and of metallic soap ($\geqq 1$ g/m$^2$). Accordingly, the Ca/Zn ratio of the calcium zinc coating is preferably in the range 0.3-1.0.

The predetermined coating weight of the calcium zinc phosphate coating weight of 6 g/m$^2$ or larger is obtained in a short period of time 10-20 seconds only when the concentration of the calcium zinc phosphate solution is 160 points or higher. On the other hand, the concentration of the solution of 200 points or higher is not economical since the coating weight in proportion to the increase in the concentration is not obtained. Here, the lower limit of the coating weight of the calcium zinc phosphate coating is predetermined to 6 g/m$^2$. The prior art zinc phosphate coating having lower resistance to heat requires the coating weight of the lower limit 7-8 g/m$^2$. However, since the calcium zinc phosphate coating according to the present invention has a high resistance to heat, the coating weight of it can satisfactorily be as low as 6 g/m$^2$.

Figure 7:
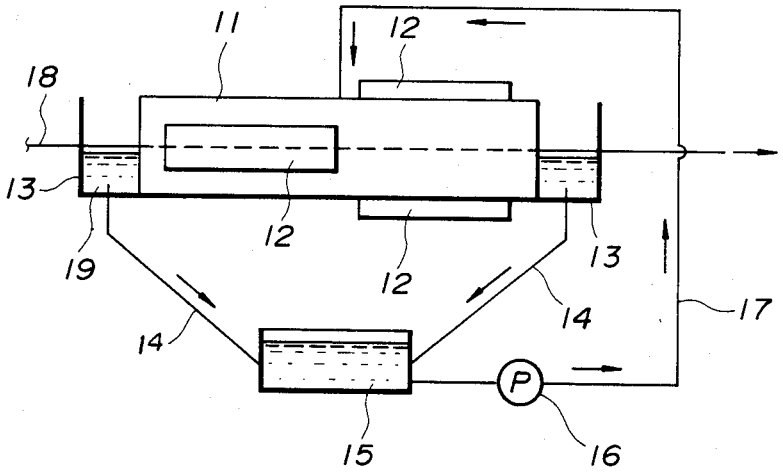
FIG. 7 is a schematic side view of an apparatus for ultrasonic pretreatment for lubrication.
Figure 8:
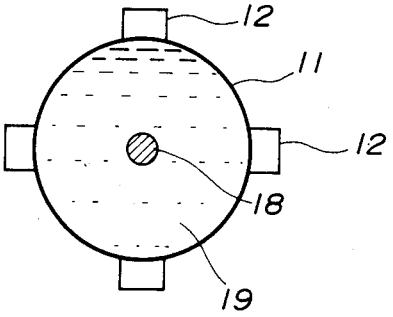
FIG. 8 is a schematic front view of a treating bath.

The apparatus used for ultrasonic pretreatment for lubrication in the method according to the present invention may take the construction in which, as shown in FIGS. 7 and 8, a plurality of ultrasonic wave applying devices 12 are disposed vertically or horizontally in pairs in parallel or staggered positions on the outer peripheral surface of a cylindrical treating bath 11, return pipes 14 are provided between treating solution receivers 13 projecting from the inlet side and the outlet side, respectively, of the treating bath 11 and a treating solution tank 15 to collect treating solution 19 therethrough, and a pump 16 is provided to supply the treating solution from the treating solution tank 15 to the treating bath 11 through piping 17. By the apparatus constructed as described above, the calcium zinc phosphate solution is subjected to the ultrasonic wave and agitated, and caused to rapidly adhere to the surface of a wire rod 18 by cavitation. Further, it is made possible to control the coating weight of the calcium zinc phosphate solution by using or not using the application of the ultrasonic wave or by changing the frequency or the output of the ultrasonic wave applying device.

The lubrication process is carried out after the lubrication pretreatment process by passing the wire rod either (1) through calcium stearate solution at room temperature or (2) through sodium stearate solution heated to the temperature 70°-90° C.

Figure 5:
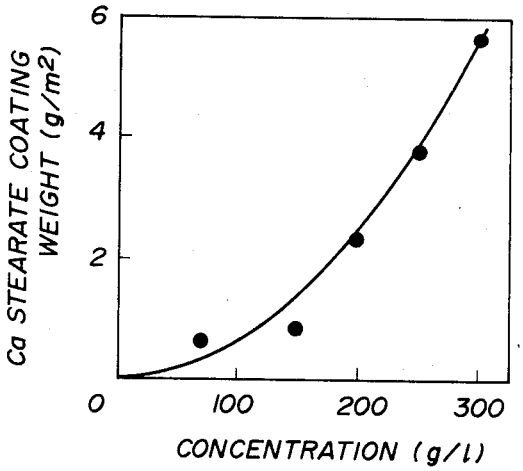
FIG. 5 is a graph showing the relationship between the concentration of calcium stearate and the calcium stearate coating weight.

In lubrication with calcium stearate (1), as will be understood from the relationship between the concentration and the coating weight shown in FIG. 5, the concentration must be 300 g/liter or higher in order to obtain the predetermined coating weight of 5 g/m$^2$ or higher. While any of wet spraying (coating solution) and dry spraying (coating powder) can be used to cause calcium stearate to adhere to the wire rod, coating by wet spraying is preferred in view of the coating weight of the lubricant and the adhesiveness of the lubricant coating. Treating time of 2-3 seconds is normally required for physical adhesion.

Figure 6:
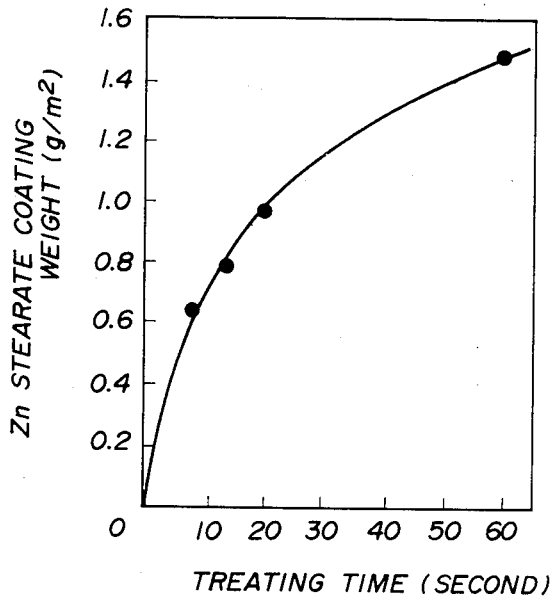
FIG. 6 is a graph showing the relationship between the treating time of the sodium stearate and the zinc stearate coating weight.

In lubrication with sodium stearate (2), batch treatment system can be used. In this lubrication with sodium stearate, substitution takes place between the calcium zinc phosphate coating formed by lubrication pretreatment and the sodium stearate solution to produce a zinc stearate layer which adheres to the surface of the wire rod. In this lubrication, it is normally required to obtain the coating weight of the substitution product layer of 1 g/m$^2$ or higher. For this purpose, as seen from the relationship between the treating time with sodium stearate and the zinc stearate coating weight shown in FIG. 6, a period of time of 20 seconds or longer is required.

The lubrication (1) or (2) above may be omitted in the case where a predies lubricant is used during wire drawing process.

In the method according to the present invention, the predies lubricant is added to increase the heat-resistance and lubricating properties. The predies lubricant used in the method according to the present invention is the lubricant having metallic soap as the main component added with a thermoplastic resin such as Teflon, polyethylene, nylon, acrilic resin, and polycarbonate in 1-10% by weight. The thermoplastic resin is added to the metallic soap lubricant to make use of the heat-resistance and the low friction of the thermoplastic resin such, for example, as Teflon. Further, the quantity of addition of the thermoplastic resin is determined to 1-10% by weight because addition of it in less than 1% is not sufficient to provide an effect to the drawing force and, on the other hand, while a larger quantity of addition of it provides a larger effect, the upper limit of the quantity of its addition is determined to 10% considering the cost and the fact that the decomposition gas of, for example, Teflon is fluorine gas.

Figure 9:
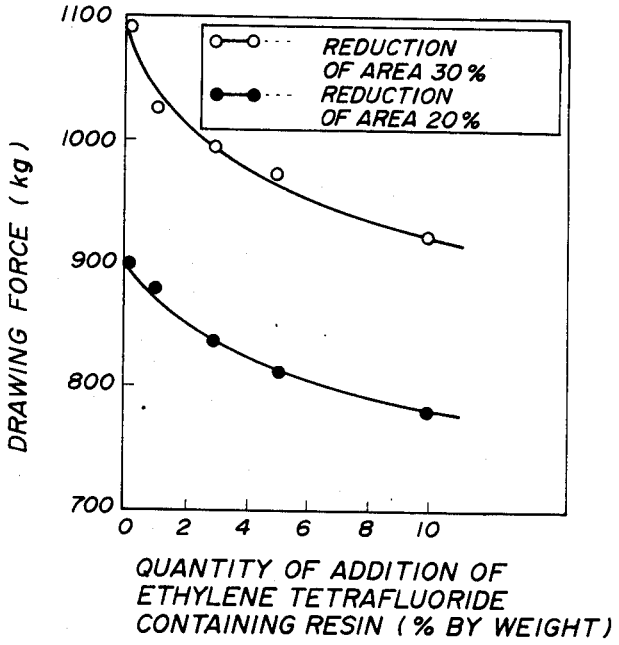
FIG. 9 is a graph showing the relationship between the quantity of ethylene tetrafluoride resin added to the predies lubricant having metallic soap as the main component and the drawing force in the wire drawing operation using the lubricant.

FIG. 9 shows graphically the relationship between the quantity of addition of ethylene tetrafluoride (trademark "Teflon") to the wire drawing lubricant containing metallic soap as the main component (having the content: calcium stearate 70%, lime 27%, and sulfur 3% by weight) and the drawing force required to draw a steel rod (equivalent to S45C of JIS—Japanese Industrial Standard) into wire. The graph of FIG. 9 shows the results of drawing of said steel rod coated with zinc phosphate as the lubrication pretreatment and having the diameter 5.5 mmϕ into wires with two different reduction of area, approximately 20% and approximately 30%, respectively.

It is clear from FIG. 9 that the required drawing force shows the tendency to decrease suddenly when the quantity of addition of the ethylene tetrafluoride containing resin exceeds 1% by weight. This tendency has been confirmed to appear likewise when other thermoplastic resin is added. While the graph of FIG. 9 shows that the thermoplastic resin is added preferably in larger quantity from the view to increase the lubrication, the quantity of its addition is required to be limited to 10% by weight or less in view of the environmental pollution and economy as mentioned hereinabove.

Figure 10:
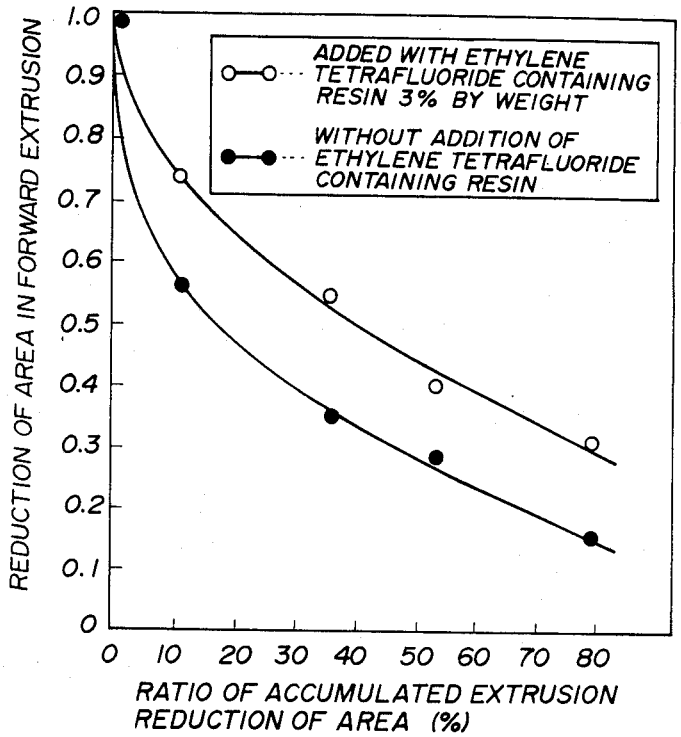
FIG. 10 is a graph showing the adhesiveness of the lubricant coating in the cold-forging process.

FIG. 10 shows graphically the comparative results of the adhesiveness of the lubricant coating to the rod being worked between the predies lubricant with no resin added and the predies lubricant with a thermoplastic resin added.

The wire drawing lubricant, the thermoplastic resin added and the lubrication pretreatment method used in the tests shown in FIG. 10 were the same as those used in the tests of FIG. 9, and the wire rod used was a boron steel equivalent to 10B22M of AISI. The coating weight was measured in the manner described below.

A boron steel rod of the diameter 22 mmϕ coated with zinc phosphate or zinc calcium phosphate (pretreatment for lubrication) was drawn into rod of 19.5 mmϕ with the reduction of area of approximately 21.4% using both of the predies lubricant added with no resin and the predies lubricant added with ethylene tetrafluoride containing 3% by weight, and subjected to cold-forging (extruding to make bolts) during which sampling is started to find the rate of residual lubricant on the drawn rod (extruding reduction of area=0) at each extruding reduction of area. That is, the adhesiveness of the lubricant coating is understood as the following ratio:

$$\frac{\text{coating weight after extrusion}}{\text{coating weight to mother material}}$$

Figures 11A, 11B:
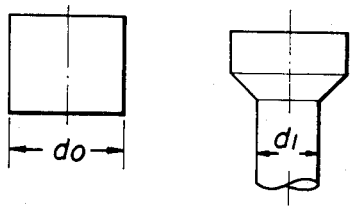
FIG. 11*a* is a schematic view of the shape of the cut wire rod before cold-forging.
FIG. 11*b* is a schematic view of the shape of the product of the cold-forging.

The larger the value of the rate of residual lubricant coating is, the better the adhesiveness of the coating is or the more the lubricant remains and, accordingly, the less frequently the seizure occurs during the cold-forging operation. In the cold-forging used in the method according to the present invention, a rod (diameter: $d_0$) shown in FIG. 11*a* is formed to, as shown in FIG. 11*b*, a bolt-like shape (diameter of shank: $d_1$) leaving a head undrawn, with the ratio of maximum accumulated reduction of area of approximately 80%. In this case, the ratio of reduction of area is given by the formula:

$$\left[1 = \left(\frac{d_1}{d_0}\right)^2\right] \times 100.$$

It is understood from the results shown in FIG. 10 that the predies lubricant added with ethylene tetrafluoride containing 3% by weight is obviously superior in adhesiveness of the lubricant coating to the lubricant added with no resin. This shows that the addition of the ethylene tetrafluoride increases the heat resistance of the lubricant and prevents its deterioration by heat generated during working.

Figure 12:
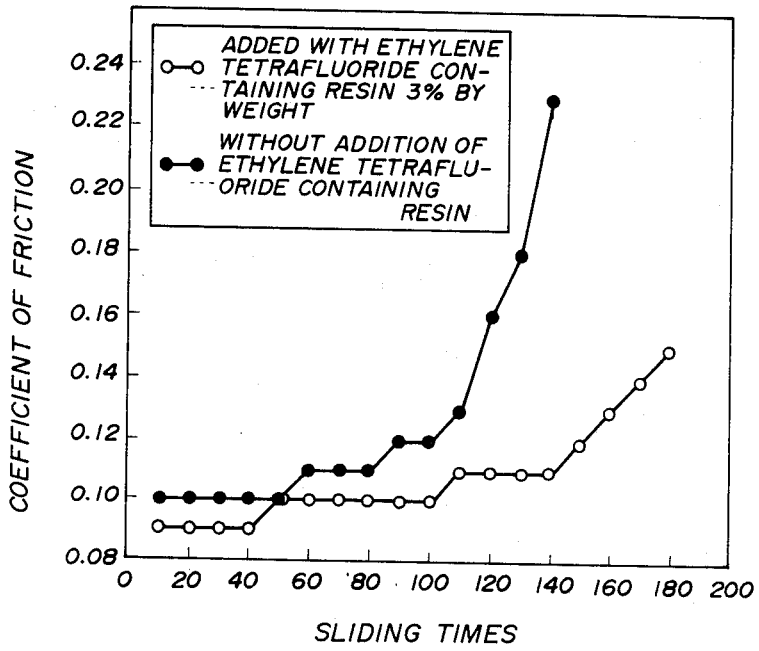
FIG. 12 is a graph showing comparatively the results of Bowden tests of the materials subjected to wire drawing and cold-forging using the lubricant according to the present invention and the conventional lubricant, respectively.

FIG. 12 shows the results of Bowden tests (using a Bowden tester for rubbing the surface of the test piece by a steel ball to determine the coefficient of friction corresponding to the number of sliding times) using extruded rods obtained by the cold-forging process described above (extrusion reduction of area: approximately 79.5%).

It is understood from FIG. 12 that the rod coated thereon with the predies lubricant added with the ethylene tetrafluoride in 3% by weight has obviously lower coefficient of friction than the rod coated thereon with the predies lubricant added with no such resin and is lower in the rise of the coefficient of friction than it. Therefore, FIG. 12 shows that the predies lubricant added with the thermoplastic resin is superior in lubricating properties and adhesiveness of its coating.

EXAMPLE

By the equipment having the line construction shown in FIG. 1, using shot blasting for descaling of the wire rod, and including the ultrasonic pretreatment apparatus for lubrication shown in FIGS. 7 and 8, a material of 5.5 mmϕ (S45C) was drawn in the following operative conditions into rods of 4.95 mmϕ and 4.6 mmϕ, respectively:

Operating Conditions (1) Descaling Condition
- Shot blasting Material: steel balls 0.3 mmϕ
- Shot Density: approximately 300 Kg/m$^2$ (2) Preheating Condition
- Steam Blowing: at temperature of 80° C.

(3) Lubrication Pretreatment Condition
- Lubrication Pretreating Agent: calcium zinc phosphate solution (Ca/Zn=0.5)
- Treatment Condition: 160 points (concentration )×80° C. (temperature)×15 sec. (reaction time), ultrasonic wave: 50 KHZ, 1 KW (4) Lubricating Condition
- (i) When using calcium stearate
  - Concentration: 300 g/liter
  - Temperature: room temperature
  - Time: 3 seconds
- (ii) When using sodium stearate
  - Concentration: 90 g/liter
  - Temperature: 80° C.
  - Time: 25 seconds (5) Drying Condition
- Infrared Drying Furnace: furnace temperature 80° C.

(6) Wire Drawing Condition
- Predies Lubricant: lubricant having calcium stearate as the main component added with Teflon in 3%
- Reduction of Area:
  - approximately 19% (5.5 mmϕ→4.59 mmϕ)

approximately 30% (5.5 mmϕ→4.6 mmϕ)

Wire Drawing Speed: 80 m/mm

Table 1 shows the drawing force in the method according to the present invention in comparison with prior art method (Lubrication Pretreatment: zinc phosphate, Predies Lubrication: only a lubricant on the market having calcium stearate as the main component).

TABLE 1

| | Lubricating Condition | Drawing Force: Ratio of Drawing Reduction of Area (%) 5.5ϕ → 4.95ϕ (approx. 19%) | 5.5ϕ → 4.6ϕ (approx. 30%) |
|---|---|---|---|
| Present Invention | | | |
| 1 | calcium zinc phosphating — predies lubrication added with Teflon | 785 Kg. | 970 Kg |
| 2 | calcium zinc phosphating — calcium stearate + predies lubrication added with Teflon | 770 Kg | 950 Kg |
| 3 | calcium zinc phosphating — sodium stearate + predies lubrication added with Teflon | 730 Kg | 910 Kg |
| Prior Art | zinc phosphating — calcium stearate predies lubrication | 822.5 Kg | 1032.5 Kg. |

FIG. 10 shows the results of Bowden tests (lubricating properties and adhesiveness of the lubricant coating) of the rod after winding. Table 2 shows the number of sliding times when $\mu=0.2$ in comparison between the method according to the present invention and the prior art method.

TABLE 2

| | | Bowden Sliding Times ($\mu$ = 0.2): Ratio of Reduction of Area 5.5ϕ → 4.95ϕ | 5.5ϕ → 4.6ϕ |
|---|---|---|---|
| Present Invention | 1 | 300 | 215 |
| | 2 | 330 | 240 |
| | 3 | 365 | 270 |
| Prior Art | | 92 | 74 |

Table 3 shows the life of each of the wire drawing dies and the cold-forging dies used for drawing rods under the conditions described above (provided, the drawing reduction of area: 5.5ϕ→4.95ϕ) and then cold-forging them into high tension bolt in comparison with such life in the prior art.

TABLE 3

| | Life of Wire Drawing and Cold-Forging Dies: Wire Drawing Dies | Cold-Forging Dies |
|---|---|---|
| Present Invention | 50 tons | 800 tons |
| Prior Art | 10 tons | 240 tons |

Life is expressed by tons of products before replacement of the dies for wear or damage thereof.

Figure 13:
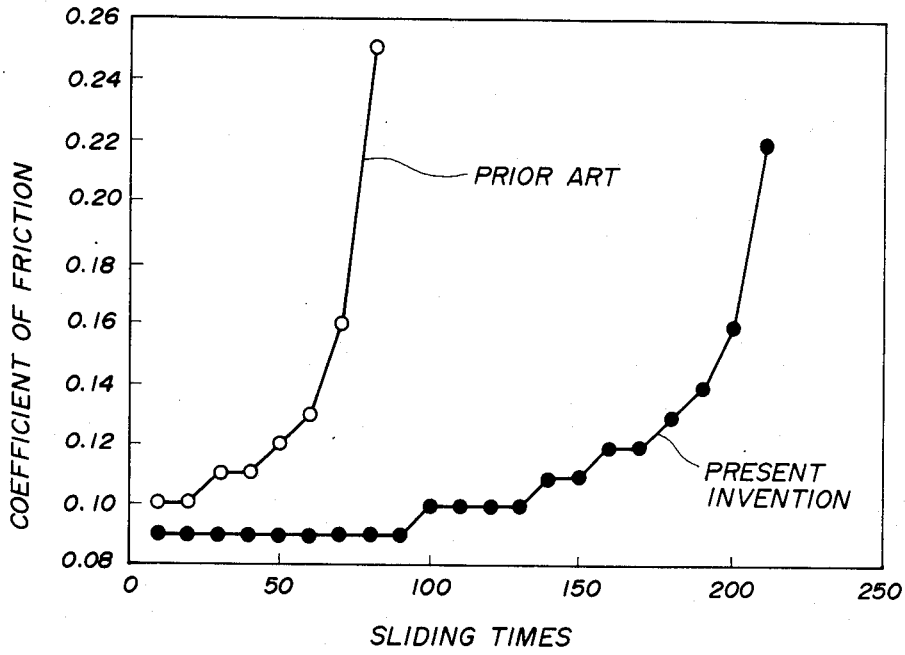
FIG. 13 is a graph showing the results of Bowden tests of the material in an example of the present invention.

As will be seen from Tables 1 and 2 and FIG. 13, the lubricant coating according to the present invention is superior in heat resistance and adhesiveness to the zinc phosphate coating according to the prior art. Accordingly, the life of the drawing and the cold forging dies is considerably prolonged in the method according to the present invention.

In the method according to the present invention, as described hereinabove, since calcium zinc phosphate is used as the lubrication pretreating agent, it is made possible to obtain a coating having a higher temperature of removing crystal water and a higher heat resistance than the zinc phosphate coating according to the prior art, and since an ultrasonic wave applying device is used, it is made possible to secure and control freely coating weight of the calcium zinc phosphate coating. Further, since the lubricant pretreated rod is lubricated by calcium stearate or dodium stearate, the lubricating properties as well as the heat resistance can be improved. Moreover, since a prior art lubricant having metallic soap as the main component added with a thermoplastic resin such as Teflon is used as the predies lubricant during wire drawing operation, it is made possible to improve the heat resistance and the lubricating properties of the lubricant coating and to prolong considerably the life of the cold-working tools.

While we have described and illustrated a present preferred method of practicing the invention, it is to be distinctly understood that the invention is not limited thereto but may be otherwise variously practiced within the scope of the following claims.

What is claimed is:

1. A method for continuously drawing a wire rod into a wire, comprising the steps of:
descaling the wire rod;
preheating the descaled wire rod;
pretreating the preheated wire rod for lubrication by passing said rod through a calcium zinc phosphate solution heated to 70°-90° C. and having the ratio (Ca/Zn)=0.3-1.0;
rinsing the pretreated wire rod;
lubricating the rinsed wire rod by coating said rod with a calcium stearate or a sodium stearate;
drying the lubricated wire rod;
lubricating the dried wire by coating said wire with a predies lubricant having metallic soap as the main component added with an ethylene tetrafluoride in 1-10% by weight; and
drawing the dried wire rod into a wire.

2. A method according to claim 1, characterized in that an ultrasonic wave is applied to said calcium zinc phosphate solution in said process of pretreatment for lubrication.

3. A method according to claim 1, characterized in that the ultrasonic wave applied to said calcium zinc phosphate solution has the frequency of 10-60 KHZ and the output of 25 W/1 liter solution.

4. A method according to claim 1, characterized in that, in said lubricating process, said pretreated wire rod is coated with a calcium stearate at room temperature.

5. A method according to claim 1, characterized in that said pretreated wire rod is passed through a sodium stearate solution heated to 70°-90° C. to coat it with said solution.

6. A method according to claim 1, characterized in that, in said process for drawing wire after drying, a wire drawing lubricant having metallic soap as the main component added with a thermoplastic resin in 1-10% by weight is used as the predies lubricant.

7. A method according to claim 1, characterized in that said calcium zinc phosphate solution has the ratio (Ca/Zn)=0.3-0.5.

* * * * *

UNITED STATES PATENT AND TRADEMARK OFFICE

CERTIFICATE OF CORRECTION

PATENT NO. : 4,688,411

DATED : August 25, 1987

INVENTOR(S) : Hyoji Hagita, et al

It is certified that error appears in the above-identified patent and that said Letters Patent is hereby corrected as shown below:

On the title page assignee should read

[73] Assignee: Sumitomo Metal Industries, Ltd.

[30] Foreign Application Priority Data:
Japan 59-102339 - 5/21/84
Japan 59-164150 - 8/3/84

Signed and Sealed this

Sixteenth Day of February, 1988

*Attest:*

*Attesting Officer*

DONALD J. QUIGG

*Commissioner of Patents and Trademarks*